US008608028B2

(12) United States Patent
Hartmann

(10) Patent No.: US 8,608,028 B2
(45) Date of Patent: Dec. 17, 2013

(54) TUBE DISPENSING DEVICE

(76) Inventor: Heinz Hartmann, Pfullingen (DE)

( * ) Notice: Subject to any disclaimer, the term of this patent is extended or adjusted under 35 U.S.C. 154(b) by 355 days.

(21) Appl. No.: 12/672,225

(22) PCT Filed: Aug. 8, 2008

(86) PCT No.: PCT/EP2008/006555
§ 371 (c)(1),
(2), (4) Date: Jan. 28, 2011

(87) PCT Pub. No.: WO2009/021690
PCT Pub. Date: Feb. 19, 2009

(65) Prior Publication Data

US 2011/0108576 A1 May 12, 2011

(30) Foreign Application Priority Data

Aug. 10, 2007 (DE) ..... 10 2007 037 769

(51) Int. Cl.
*B65D 35/28* (2006.01)

(52) U.S. Cl.
USPC ..... 222/103

(58) Field of Classification Search
USPC ..... 222/103, 105, 107, 92, 95
See application file for complete search history.

(56) References Cited

U.S. PATENT DOCUMENTS

| | | | | | |
|---|---|---|---|---|---|
| 1,475,116 | A | * | 11/1923 | Harvey | 222/103 |
| 1,510,848 | A | | 10/1924 | Hubbard | |
| 1,876,489 | A | | 9/1932 | Collins | |
| 2,053,697 | A | * | 9/1936 | Cassanos et al. | 222/103 |
| 2,210,226 | A | * | 8/1940 | Weisberger | 222/103 |
| 2,759,636 | A | * | 8/1956 | Albert et al. | 222/103 |
| 2,857,079 | A | * | 10/1958 | Hall | 222/103 |
| 2,903,161 | A | * | 9/1959 | Bernhardt | 222/81 |
| 3,211,341 | A | | 10/1965 | Bailey | |
| 3,675,822 | A | * | 7/1972 | Casali et al. | 222/103 |
| 3,734,351 | A | * | 5/1973 | Gaudin | 222/103 |
| 4,448,329 | A | * | 5/1984 | Vilaseca et al. | 222/96 |
| 4,677,797 | A | * | 7/1987 | Roth | 52/94 |
| 5,105,984 | A | * | 4/1992 | Kazimir | 222/103 |
| 5,480,066 | A | * | 1/1996 | Blum | 222/103 |
| 5,890,625 | A | * | 4/1999 | de Laforcade | 222/103 |
| 5,897,030 | A | * | 4/1999 | Stangle | 222/103 |
| 5,920,967 | A | * | 7/1999 | Souza | 24/563 |
| 6,669,055 | B1 | * | 12/2003 | Coleman et al. | 222/103 |
| 7,077,292 | B2 | * | 7/2006 | Turano | 222/103 |
| 2004/0035880 | A1 | * | 2/2004 | Coleman et al. | 222/95 |
| 2010/0163581 | A1 | * | 7/2010 | Vandromme | 222/214 |

FOREIGN PATENT DOCUMENTS

| | | |
|---|---|---|
| BE | 418 523 | 12/1934 |
| DE | 79 29 593 | 1/1980 |
| DE | 39 41 751 | 8/1990 |
| FR | 626 466 | 9/1927 |
| FR | 1 210 659 | 3/1960 |

* cited by examiner

*Primary Examiner* — Kevin P Shaver
*Assistant Examiner* — Patrick M Buechner
(74) *Attorney, Agent, or Firm* — Michael J Striker

(57) ABSTRACT

The invention relates to a tube dispensing device (10) for squeezing out the content of a tube using two pressure plates (12, 13), which are disposed transverse to each other at the pressure sections (15, 16) thereof, at least in the case of a lack of a tube to be squeezed, wherein a base (11) is provided, from which the pressure sections (15, 16) protrude. In this manner the tube may be stored standing up, and may be completely emptied.

17 Claims, 4 Drawing Sheets

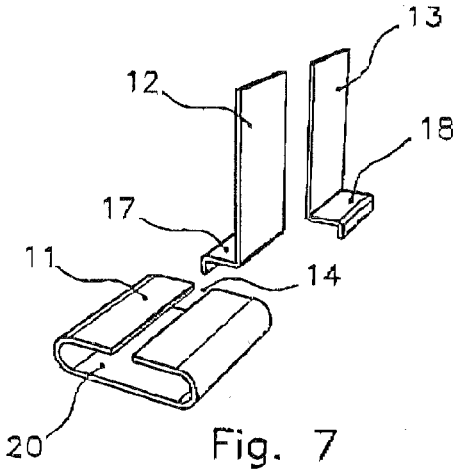
Fig. 7
Fig. 9
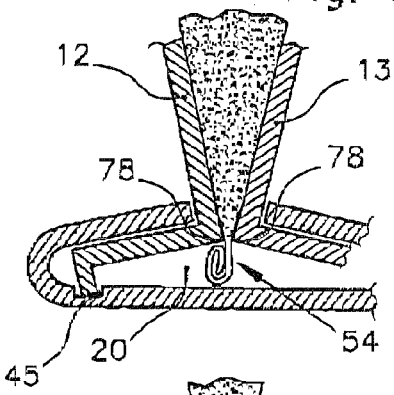
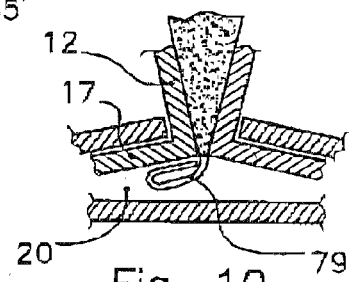
Fig. 10
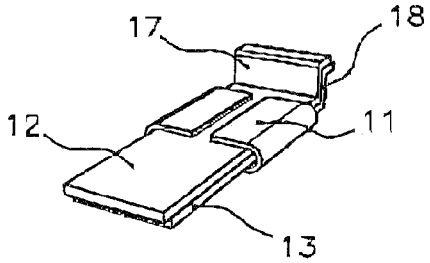
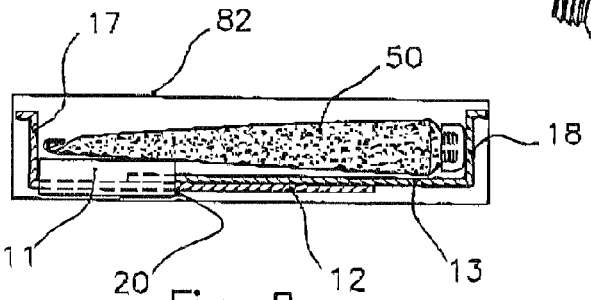
Fig. 8
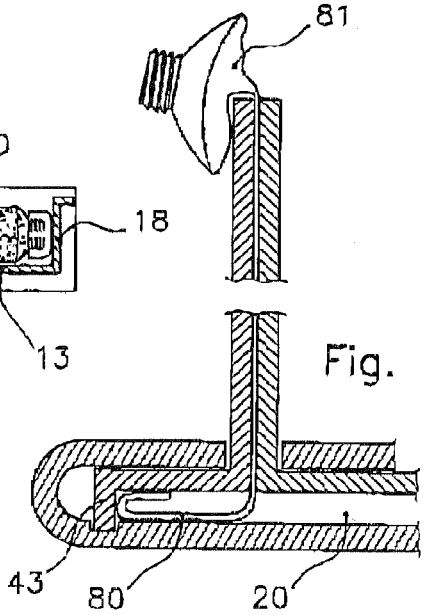
Fig. 11

TUBE DISPENSING DEVICE

The present invention relates to a tube dispensing device for squeezing out the contents of a tube using two pressure plates.

Foodstuffs, pharmaceuticals, cosmetics, etc. are often packaged in tubes. A high percentage thereof are aluminum tubes. Dispensing the entire contents of a tube is problematic. Often, the tube is deformed in such a manner that it is not possible to dispense the entire contents, or in such a manner that ruptures may form, through which the contents may escape. Ruptures of this type in aluminum tubes create the further problem that air may enter at these points, thereby causing the contents to dry out, oxidize, become contaminated, or to spoil quickly, and so the safety of the pharmaceutical or foodstuff is not longer ensured. In order to dispense the entire contents of the aluminum tube, these tubes are often rolled up from the end of the tube. As a result, however, the labeling on the tube, which includes information, e.g., about the medical indication, the required storage temperature, warnings, or even the expiration date, is no longer visible. This is likewise disadvantageous in terms of food and pharmaceutical safety.

One of the methods that was previously described to handle this problem is to modify the tube itself. For example, it was proposed to manufacture the tube out of a different material.

For example, tubes were developed out of plastic, as were "laminated" tubes, in which a thin layer of aluminum is embedded. Instead of being collapsible, the tube jacket is elastic. The shape and imprinting are retained (they remain visible). Ruptures occur less frequently. The disadvantage is that air is drawn in when the tube jacket elastically returns to its original shape. The retained air shortens the shelf life and makes it difficult to dispense individual doses or all of the product. The fact that these tubes are typically stored upside down on a widened threaded cap is not helpful, either.

In addition, the ecological and economic disadvantages compared to the 100%-recyclable aluminum tube make these solutions questionable.

Another potential solution has involved providing objects that are used to completely empty a tube. For example, DE 39 41 751 A1 makes known a device for squeezing toothpaste out of a tube. The disadvantage of this object is that the device must be continually repositioned. It is not possible to easily empty the tube of its entire contents using this device, either.

To make it easier for the user to empty a tube of its contents, it is also known to provide the tube with "tube keys". They take up very little space and may therefore be easily included in the final package with the tube. The tube is wound up from its end using the tube key.

The disadvantage is that the printing on the jacket of the tube disappears. Information that must be provided, by law, to protect the consumer, such as information about the contents, field of application, dosing quantity, potency, side-effects, expiration date, storage temperature, or warnings (e.g., caustic, flammable, etc.) are literally wound away using the tube key. The well-intentioned tube key that is included in the package therefore causes more harm than good for the user, under certain circumstances.

Devices are known (see above), in the case of which the tube is not rolled up, but rather is pressed flat. These take up substantially more space, however, and are therefore not suited to be included in the final package with the tube.

The object of the present invention is to prevent the disadvantages described above.

This object is attained in a particularly simple and surprising manner using a tube dispensing device of the type described initially, in the case of which a base is provided, away from which the pressure sections extend, and in which the pressure sections may be spread apart, against a return force, in the region of the base. Using the tube dispensing device according to the present invention, it is possible to empty tubes of their entire contents. This may be accomplished without rolling up the tube. The labeling on the tube is therefore accessible at all times. The pressure plates may be easily moved manually. Finger pressure is transferred to the pressure plates. The tube mass is moved (exclusively) in the direction of the tube outlet; plastic tubes are more easily dispensed, since air is expelled from the tube first, followed by the tube mass. Likewise, air may be expelled from plastic tubes, and the tube may be subsequently closed with the cap, e.g., to prevent rapid deterioration of the contents. If the cap is screwed back on immediately after the tube mass has been expelled, the tendency of the tube jacket to return to its original shape is hindered, and so the extent to which the tube has been flattened is an indication of the amount of content remaining, similar to the collapsing jacket of the aluminum tube.

Given that the pressure sections may be spread apart in the region near the base, one end of the tube may be placed in the region between the pressure sections, and it is subsequently clamped in position via the restoring force. The tube dispensing device is therefore preferably designed without any fastening or holding devices for the tube.

Due to the base, the tube dispensing device may be easily stored standing up. Therefore, this is a standing base or a foot of the tube dispensing device. This makes it possible to store a partially emptied tube in a space-saving manner; the tube is oriented vertically in this case. Furthermore, the tube may remain in the tube dispensing device until it has been completely emptied. Single dosing may be carried out using the device according to the present invention. The pressure sections may be composed of the most diverse, and preferably inflexible or minimally flexible materials, e.g., wood, ceramic, glass, plastic, or metal.

It is particularly preferable for the pressure plates to be separated by a distance in the region of the base when a tube to be squeezed is not present that is less than the thickness of the tube at the end of the tube. This means that one end of the tube is clamped in position via the pressure plates in the region of the base. Preferably, the pressure plates touch one another in the region of the base when a tube is not present in the tube dispensing device. When the tube is installed, the base region is expanded, and the tube is clamped into position via one end. As a result, the tube is reliably held in the tube dispensing device.

According to the present invention, use is made of the special feature that the tube fold is substantially thicker than the tube jacket, and that the fixing in position may take place along this thickened edge using the pressure plates. In so doing, the tube fold lies below the sharp engagement edges of the pressure plates, thereby preventing the tube from sliding upward or from tilting to the side. This design, according to the present invention, provides the further advantage of improved dispensing. Since the two regions are kept separate, the thick fold is unable to prevent the thinner tube jacket from being pressed completely flat.

It is therefore advantageous when the base is elastic, so that the pressure sections may be spread apart, against a restoring force, in the region of the base. The restoring force may be applied by an elastic base. Other possibilities include spring elements or rubber bumpers on the base or the pressure plates.

According to a particularly preferred embodiment, the length of the pressure sections is matched to the length of the tube. The length of the pressure sections is preferably dimensioned such that the free ends of the pressure sections come to rest underneath the tube shoulders. By squeezing the pressure sections together, the tube may be completely emptied, up to a region below the tube shoulder. Finally, the tube shoulder may be folded over the free ends of the pressure sections, thereby making it possible to continue emptying the remaining contents of the tube.

It is particularly advantageous when the pressure sections and/or the base are transparent. It is thereby ensured that the labeling on the tube is always legible. This enhances product safety since it ensures that, e.g., a medical indication, instructions for use, or an expiration date is visible at all times.

Transparent pressure sections may be realized in a particularly easy manner when the pressure plates are composed of wood, metal, plastic, e.g., Plexiglas or polycarbonate, glass or ceramic.

According to an embodiment of the present invention, the pressure plates and the base may be designed as a single piece. This has the advantage of providing a particularly stable design.

According to an alternative embodiment, the pressure plates and the base may be separate pieces that may be fitted together. This means that the tube dispensing device, which is composed of separate pieces, may be easily disassembled. The tube dispensing device may be stored in a space-saving manner when not in use. In addition, once the tube dispensing device is disassembled into its individual parts, it may be easily cleaned. A further advantage is the fact that one of the pressure plates or even the entire tube dispensing device may be used to push the very last amount of product out of the tube. Once a tube dispensing device has been disassembled, it may be packaged in a box together with a tube in a particularly easy manner. In particular, the tube dispensing device may be included in the package without having to change the size of the box. A description, e.g., of how to assemble the tube dispensing device, may be placed between the pressure plates which are preferably transparent. Therefore, simply by designing the pressure plates and the base in a manner according to the present invention, it is possible to fix and empty the tube in an optimal manner, while, at the same time, the tube dispensing device takes up so little space that it may be included in the tube package. The individual parts may therefore be fitted together in a variable manner, e.g., for use as a tube dispensing device, or for shipping, storage, or packaging.

In a development, the base may include a slot in which the pressure plates are located, being clamped therein in particular, via one section. To assemble the tube dispensing device, the pressure plates are simply slid into the slot. The pressure plates are clamped in position in the slot. When a tube is slid between the pressure plates, it is also clamped in position. By providing a slot in the base, the assembly and disassembly of the tube dispensing device is simplified.

It is particularly preferable for the pressure plates to be identical in design. As a result, it does not matter which pressure plate is installed on which side.

In a particularly preferred embodiment of the present invention, the pressure plates are L-shaped in design, and the shorter leg is located in the base when the tube dispensing device is assembled. The hold in the base is improved as a result. There is preferably open space located underneath the short legs, into which a tube end may be slid, thereby also making it possible to completely empty long tubes.

If the shorter legs include spacers on their free ends that face the base bottom, then the pivot motion performed by the pressure plates when a tube is squeezed may be supported.

It is particularly preferable to provide a counter bearing for the shorter legs in the base bottom. For example, a channel into which the spacer on the shorter legs may engage may be provided as the counter bearing. As a result, the pressure plates are fixed in their position in the base. A strip may also be used as the counter bearing, and it may be used in place of the spacer. It is also feasible to provide a welt-type thickening, for example, on the free end of the shorter leg, which is supported in a groove-type recess in the base, thereby resulting in a type of swivel joint.

In a preferred embodiment of the present invention, the base includes a passage, the height of which corresponds to approximately twice the thickness of the pressure plates, and the length of which corresponds to approximately the width of the pressure plate. As a result, once the tube dispensing device has been disassembled, the pressure plates may be slid via their pressure sections into the open space and are thereby held together by the base. This is advantageous in terms of storing the tube dispensing device. The passage that is dimensioned in this manner is also used as an open space for the tube fold.

An even more reliable method of holding a tube in a tube dispensing device may be realized by designing the pressure sections to be friction-increasing, and to include toothing, in particular, in the region of the base. This design is particularly advantageous for use with plastic tubes that do not include a tube fold. The pressure plates may be identical in design.

When the base includes a channel in the base bottom for accommodating the tube fold, the tube is prevented from tilting laterally in the tube dispensing device. The tube stands up straight, and the tube fold is prevented from sliding to one side.

Further advantages result when at least one of the pressure plates and/or the base includes printing, engraving, and/or a piece of printed film. The pressure plates may be used thereby for advertising purposes, for instance.

When the base is composed of stainless steel, the required elasticity of the base is ensured, and the tube dispensing device is provided with a higher-quality appearance. It thereby also becomes a table-top decoration. The base may be composed of wood, glass, ceramic, or plastic.

Furthermore, a locking device may be provided in order to lock the pressure plates in the base. For example, the locking may be designed as a detent-action device that includes a projection and a recess.

When the pressure plates extend into the interior of the base, the clamping of the tube is improved. Furthermore, open space may be provided in the base for accommodating the emptied tube end. It is thereby possible to adapt to the size of the tube.

Further features and advantages of the present invention result from the detailed description of embodiments of the invention presented below with reference to the figures in the drawing which shows the details that are essential to the present invention. Further features and advantages of the present invention also result from the claims. The features described therein are not intended to be interpreted literally, and are presented in such a manner that the special features of the present invention may be presented clearly. The various features may be realized individually, or they may be combined in any possible manner in different variations of the present invention.

Embodiments of the present invention are depicted in the schematic drawing and are described in greater detail in the description that follows.

FIG. 7 shows how simple it is to disassemble and assemble a tube dispensing device for placement in a final package;

FIG. 8 shows a tube dispensing device, as an auxiliary product in a final package;

FIG. 9 shows an illustration of a tube that has been clamped into position, in which its fold extends downwardly beyond the pressure plates;

FIG. 10 shows a tube with bent fold; and

FIG. 11 shows an illustration of the use of the open space in the base.

Figure 1:
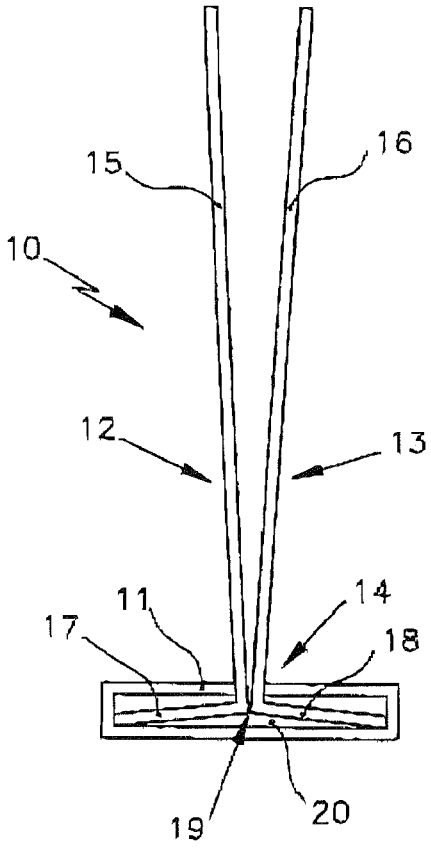
FIG. 1 shows a first embodiment of the present invention that includes a separate base and pressure plates, in a side view.

FIG. 1 shows a tube dispensing device 10 that includes a slot 14, into which two pressure plates 12, 13 have been inserted. Pressure plates 12, 13 include pressure sections 15, 16 that, in the embodiment, are situated at a slant relative to one another, and may be moved toward one another. Pressure sections 15, 16 may also extend parallel to one another when a tube is not present.

The pressure sections therefore form the shape of a "V" as viewed from the side. When pressure sections 15, 16 are moved toward one another, a tube that is located between pressure sections 15, 16 is squeezed.

Pressure plates 12, 13 also include short legs 17, 18 which are located in an interior of base 11. Base 11 is somewhat elastic in design, thereby making it possible to separate pressure plates 12, 13 in region 19 in order to insert a tube end and clamp it in place. Open space 20, into which a tube end or a tube fold may extend, exists underneath short legs 17, 18. When pressure sections 15, 16 are moved toward one another, pressure plates 12, 13 perform a type of swivelling motion. When pressure plates 12, 13 are moved apart from each other at the top, region 19 is lifted up since legs 17, 18 bear against the base bottom, thereby separating pressure plates 12, 13, against a restoring force, in this region.

The height of the interior of base 11 is dimensioned such that pressure plates 12, 13 may be placed one on top of the other and then inserted into the inner space. The length of base 11 is therefore dimensioned such that it is greater than the width of pressure plates 12, 13.

Figure 2:
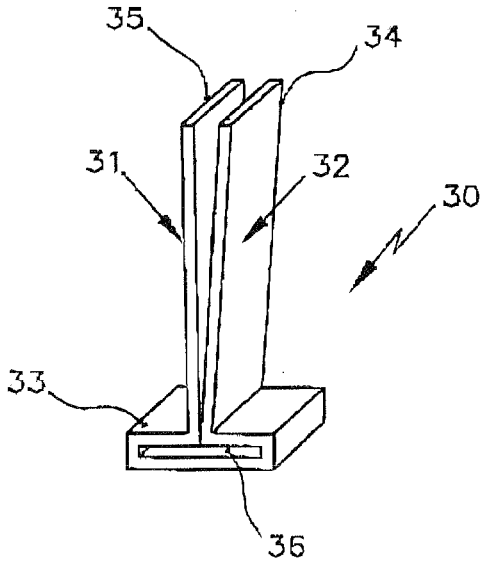
FIG. 2 shows a further embodiment that includes a single-pieced tube dispensing device, in a perspective view.

FIG. 2 shows an alternative embodiment of a tube dispensing device 30. This embodiment is single-pieced in design. This means that pressure plates 31, 32 are an integral component of base 33, via which tube dispensing device 30 may be stood upright. In the illustration shown, pressure plates 31, 32 and pressure sections 34, 35 are situated at a slant relative to one another, and they touch one another in the region of base 33. A tube may be clamped in position at this point, and the tube fold may extend into interior 36 of base 33. By moving pressure plates 31, 32 apart from each other, the region between the pressure plates that is close to the base is also enlarged, against a restoring force.

Figure 3:
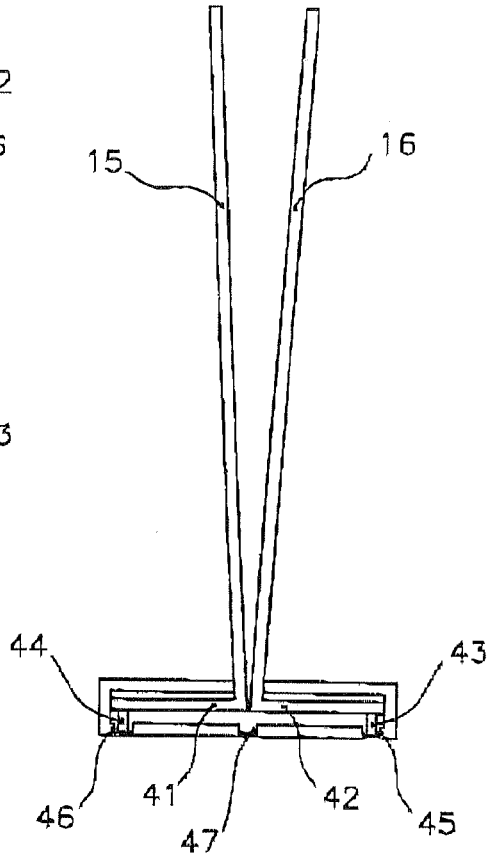
FIG. 3 shows an embodiment that includes a spacer on the short legs of the pressure plates.

In the embodiment shown in FIG. 3, the angle formed by shorter legs 41, 42 and pressure sections 15, 16 is more acute than it is in the embodiment shown in FIG. 1. They still have an L shape, however. Spacers 43, 44, which extend into corresponding channel-type counter bearings 45, 46, are provided on the free ends of short legs 41, 42. Situated approximately in the center is a channel 47, into which a fold of a tube may extend in order to orient the tube. The angle between pressure sections 15, 16 and short legs 41, 42 may be selected such that it is suitable, in particular ≤120°, and preferably 90°. The clamping effect may be influenced via the selection of the angle.

Figure 4:
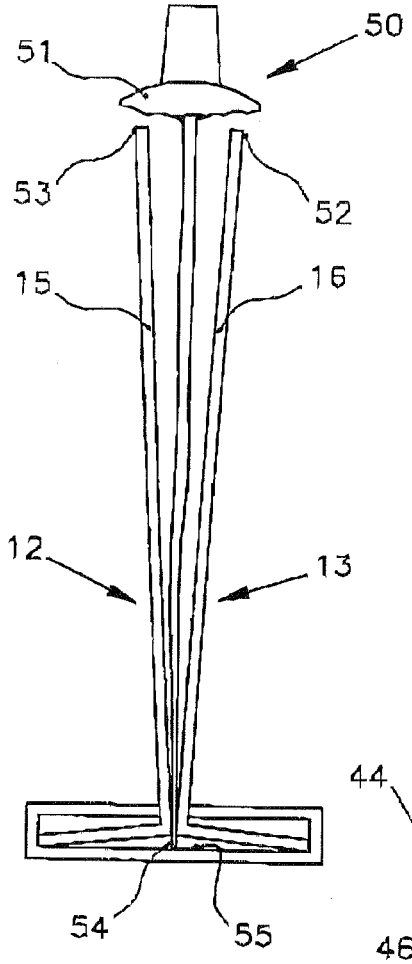
FIG. 4 shows a tube dispensing device, including a partially dispensed tube.

FIG. 4 shows a tube 50 that has been partially emptied using pressure sections 15, 16. The illustration shows that pressure sections 15, 16 are dimensioned such that they extend below shoulder 51 of tube 50 and therefore do not deform shoulder 51. In order to empty the remaining contents which are located in the region of shoulder 51, the top section of tube 50 may be folded over edges 52, 53 of pressure sections 15, 16 and pressed, from the outside, against pressure sections 15, 16. The tube may be emptied completely in this manner. The illustration also shows that tube 50 is clamped in the lower region between pressure plates 12, 13. Tube fold 54 extends to base bottom 55.

Figure 5:
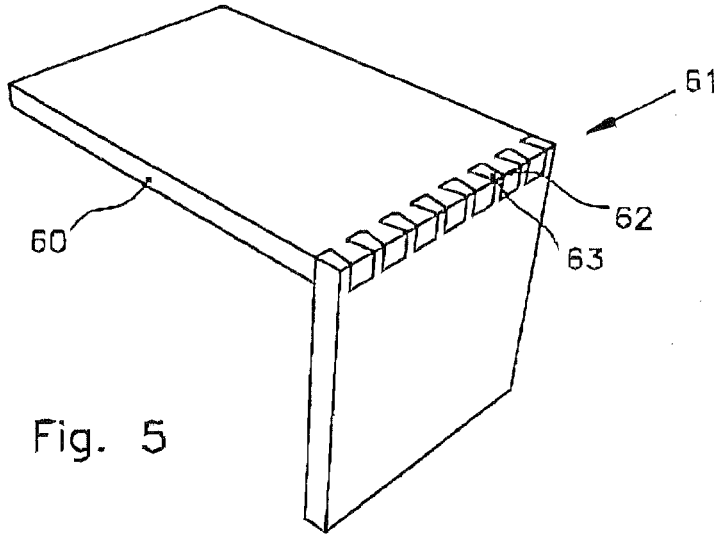
FIG. 5 shows a pressure plate that includes toothing.

FIG. 5 shows a pressure plate 60 that includes toothing 61. The toothing includes teeth 62 and tooth gaps 63. If identically-designed pressure plates 60 are used in a tube dispensing device, then one tooth 62 of a pressure plate 60 always fits into one tooth gap 63 of the other pressure plate 60.

Figure 6:
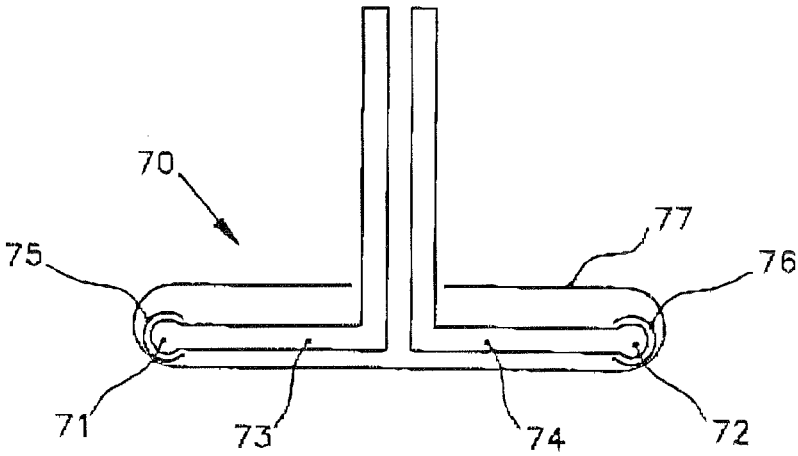
FIG. 6 shows a tube dispensing device that includes a swivelling point.

FIG. 6 shows a tube dispensing device 70, short legs 73, 74 of which include thickened ends 71, 72. Ends 71, 72 are retained in recesses 75, 76 in base 77, thereby realizing a swivel joint.

FIG. 7 shows how pressure plates 12, 13 are slid via shorter legs 17, 18 into open space 20 in base 11 and thereby bear against each other. Therefore, only two manual steps and three loose individual parts (two of which are identical) are required in order to realize the functional tube dispensing device according to the present invention. The stability and the strong clamping effect also result from the preload of elastic base 11. It results when slot 14 is narrower than the total width of the inserted pressure plates.

It is likewise easy to disassemble and reconnect the three individual pieces into a space-saving configuration for storage, e.g., as an auxiliary item in the final package for a tube. To do this, the long legs of pressure plates 12, 13 are inserted into open space 20 of base 11.

FIG. 8 shows a tube 50 in final package 82, including the tube dispensing device as an auxiliary item.

Since, in this configuration, the three pieces function as three protective walls for the tube, it is even possible to reduce the amount of packaging material required by replacing the outer package with shrink wrap. The ultimate result is a package that includes the combination of tube and dispensing device, and that requires less space than the tube and package alone.

FIG. 9 shows the use, according to the present invention, of the thickened tube end (e.g., as tube fold), as the ideal point for fixing the tube in an upright position. This is made possible by sharp angular edges 78, according to the present invention, of L-shaped pressure plates 12, 13.

The complete squeezing of the tube jacket using the pressure plates starts directly above the thickened tube end. Via the L shape according to the present invention, loose pressure plates 12, 13, with their short and long legs and spacers 43, 44, are used simultaneously as angular levers.

To insert or remove the tube, the clamping pressure in slot 14 of the elastic base must be overcome. This is accomplished very easily by pressing the ends of the long legs far enough apart. In this regard, they function as a power arm. Counter bearings 45, 46 provide the necessary support.

FIG. 10 shows a tube end, the fold of which was bent by 90°. This has two advantages:

1. The holding effect is even greater due to the broader support on short leg 17;
2. The expiration date is clearly legible since it is always located on surface 79 which faces transparent base bottom.

FIG. 11 shows a further advantage of open space 20 which is created by spacers 43, 44. It provides space for thickened ends of tubes, which may have different shapes and types of support, as well as for emptied regions.

As a result, it is also possible to slide longer tubes downward to the point where pressure plates 12, 13 extend to directly underneath tube shoulder 51. It is also clearly shown how, by tilting recess 81 sideways, to the left and right, it may be pressed against the plates and emptied.

What is claimed is:

1. A tube dispensing device (10, 30) for squeezing out the contents of a tube (50), comprising:

two pressure plates (12, 13, 31, 32, 60) formed with respective pressure sections (15, 16, 34, 35) and shorter leg sections (17, 18, 73, 74), and a base (11, 33, 77) with a base top, a base bottom and base sides connecting the base top and the base bottom, the base configured with an interior space that is open to the outside via a slot through the base top, away from which base and through which slot the pressure sections (15, 16, 34, 35) extend;

wherein the pressure sections (15, 16, 34, 35) are spread apart against a return force in a region of the base (11, 33, 77) in which the leg sections (17, 18, 73, 74) bear against the base bottom.

2. The tube dispensing device as recited in claim 1, wherein, in the absence of a tube (50) to be dispensed, the pressure plates (12, 13, 31, 32, 60) are separated from one another, in the region of the base (11, 33, 77), by a distance that is smaller than the thickness of the tube at the end of the tube.

3. The tube dispensing device as recited in claim 1, wherein the base (11, 33, 77) is elastic.

4. The tube dispensing device as recited in claim 1, wherein the length of the pressure sections (15, 16, 34, 35) is matched to the length of the tube (50).

5. The tube dispensing device as recited in claim 1, wherein the pressure sections (15, 16, 34, 35) and/or the base (11, 33, 77) are/is transparent.

6. The tube dispensing device as recited in claim 1, wherein the pressure plates (12, 13, 31, 32, 60) are composed of wood, metal, plastic, glass, or ceramic.

7. The tube dispensing device as recited in claim 1, wherein the pressure plates (12, 13, 60) are identical in design.

8. The tube dispensing device as recited in claim 1, wherein the shorter legs (41, 42) include spacers (43, 44) on their free ends that face the base bottom (55).

9. The tube dispensing device as recited in claim 1, wherein a counter bearing (45, 46) is provided for the shorter legs (41, 42) on the base bottom (55).

10. The tube dispensing device as recited in claim 1, wherein the base (11) includes a passage, the height of which corresponds to approximately twice the thickness of the pressure plates, and the length of which corresponds to approximately the width of the pressure plate.

11. The tube dispensing device as recited in claim 1, wherein the pressure sections (15, 16, 34, 35) are designed, in the region of the base (11, 33) to increase friction, and include a tooth system (61) in particular.

12. The tube dispensing device as recited in claim 1, wherein the base (11, 33) includes a channel (47) in the base bottom (55) for accommodating the tube fold (54).

13. The tube dispensing device as recited in claim 1, wherein at least one of the pressure plates (12, 13, 34, 35, 60) and/or the base (11, 33, 77) are/is provided with labeling, engraving, and/or a piece of printed film.

14. The tube dispensing device as recited in claim 1, wherein the base (11, 33, 77) is composed of stainless steel, wood, plastic, ceramic, or glass.

15. The tube dispensing device as recited in claim 1, wherein the pressure plates (11, 13, 34, 35, 60) extend into the interior of the base (11, 33, 77).

16. The tube dispensing device as recited in claim 1, wherein the base (11, 33, 77) includes an open space for accommodating the emptied tube end.

17. A tube dispensing device (10, 30) for squeezing out the contents of a tube (50), comprising:

two pressure plates (12, 13, 31, 32, 60) formed with respective pressure sections (15, 16, 34, 35) and short leg sections (17, 18, 73, 74), and a base (11, 33, 77) away from which the pressure sections (15, 16, 34, 35) extend, wherein the pressure sections (15, 16, 34, 35) may be spread apart against a return force in a region of the base (11, 33, 77), wherein the pressure plates (12, 13, 60) and the base (11, 77) are separate pieces that are fitted together, and the base has an inner space and includes a slot (14) in which the pressure plates are located, and wherein the pressure plates 12, 13, 60) are L-shaped in design such that when the tube dispensing device (10) is assembled, the shorter legs (17, 18, 41, 42) are located in the inner space of the base (11, 77).

* * * * *